455-7 SR
8/26/80 XR 4,219,891

United States Patent [19]
Weiss et al.
[11] 4,219,891
[45] Aug. 26, 1980

[54] COUNTERMEASURES SYSTEM

[75] Inventors: Gerald Weiss, New York; Gerson Scharf, Bronx; Anthony A. Guido, Yonkers; Benjamin Lazardwitz, Bronx, all of N.Y.

[73] Assignee: The United States of America as represented by the Secretary of the Army, Washington, D.C.

[21] Appl. No.: 171,320

[22] Filed: Feb. 5, 1962

[51] Int. Cl.[3] ..... H04K 3/00
[52] U.S. Cl. ..... 455/1; 455/23; 455/7; 375/4; 375/45
[58] Field of Search ..... 325/132, 32, 33; 178/22; 343/18; 455/1, 7, 20, 21, 23; 375/3, 4, 51, 45

[56] References Cited

U.S. PATENT DOCUMENTS

| | | | |
|---|---|---|---|
| 2,471,416 | 5/1949 | Deloraine et al. | 375/3 |
| 2,958,767 | 11/1960 | Labin et al. | 455/1 |
| 4,103,236 | 7/1978 | Deserno et al. | 455/1 |
| 4,103,237 | 7/1978 | Fischer | 455/1 |

*Primary Examiner*—Howard A. Birmiel
*Attorney, Agent, or Firm*—Nathan Edelberg; Sheldon Kanars; Jeremiah G. Murray

EXEMPLARY CLAIM

1. A method for jamming frequency-shift-keyed radio teletype signals which comprises: receiving said frequency-shift keyed signals; converting said signals to teletype current pulses; modification of selected ones of said teletype pulses; converting said modified teletype current pulses to frequency shifted signals; and transmitting said converted modified pulses.

7 Claims, 2 Drawing Figures

COUNTERMEASURES SYSTEM

This invention relates to a countermeasures system and method for use against frequency shift keyed (FSK) radio-teletype transmission. It is the purpose of this system to overcome the problems of previously known countermeasures systems, by making much more efficient use of the power transmitted in the countermeasure signals, and by rendering the countermeasure signals very difficult for the victim to detect.

A common method of disrupting enemy communications of any character is by jamming with continuous signals of high power and modulated in various ways, as by noise generators, to blanket the victim signals. This jamming technique requires a large radiated power from the countermeasures equipment to be effective, and is, of course, easily detected. Further, it prevents monitoring the enemy signal for its intelligence while it is being jammed, for any receiver in the vicinity of the jamming transmitter is blanketed as effectively as the victim receiver.

It is therefore a primary object of this invention to provide a method and the apparatus for jamming a radio transmission system.

It is another object of this invention to provide a teletype countermeasure system which is efficient in the use of transmitted power.

It is a further object of this invention to create a countermeasures system effective against teletype transmission and which is difficult for the enemy to detect.

It is an additional object of the system of this invention to permit monitoring the victim teletype transmission while the transmission is subjected to countermeasures activity.

These and other objects of the invention are achieved by equipment which may convert one or more radioteletype character groups or other signals into different characters or signals for the purpose of confusing enemy messages. The signals received by the countermeasures equipment are sampled by a signal modification unit which may key a transmitter to send a pulse negating or confusing the signal sampled. The system is directly applicable to frequency-shift keyed (F.S.K.) radioteletype transmission wherein the frequency of the carrier is keyed to one or the other of two frequencies to indicate the nature of the particular bit, or "baud", of information transmitted at a given instant. The countermeasures equipment may then transmit a signal of the frequency opposite to that of the victim signal at that instant. At all other times the countermeasures transmitter is silent.

The invention will be better understood from the following detailed description in conjunction with the drawings in which.

A teletype character is composed of five information-bearing intervals (bauds) preceded by a start pulse and terminated by a stop pulse. The teletype character is established by the combination of marks and spaces associated with each interval.

In a normal wire teletype system a mark pulse is represented by 60 ma. of current and a space pulse 0 ma. In radio teletype operation the 60 to 0 ma. currents produce frequency shifts in the carrier frequency. A mark signal is 425 cycles above the carrier frequency while a space signal is 425 cycles below the carrier frequency. Thus, the marks and spaces are represented by a frequency shift of 850 cycles.

Teletype characters can be grouped into two major categories; "letters-figures" and "machine functions." The first group contains 26 combinations of marks and spaces while the second group is reserved for the remaining 6 combinations, making a total of 32 combinations as illustrated in the code chart of FIG. 1.

Our invention involves changing the mark-space sequence of a victim's teletype message in such a manner that the message received by the victim is erroneous. The changes made in the mark-space combinations of a victim message depend upon the type of message being transmitted by the victim. If the message is in clear text, then the changes made should not result in a machine function conbination because this would warn the victim that someone or something is interfering with his transmission. On the other hand, if the message is coded and includes machine functions, it is permissible to make any desired changes in the mark-space combinations.

Figure 1:
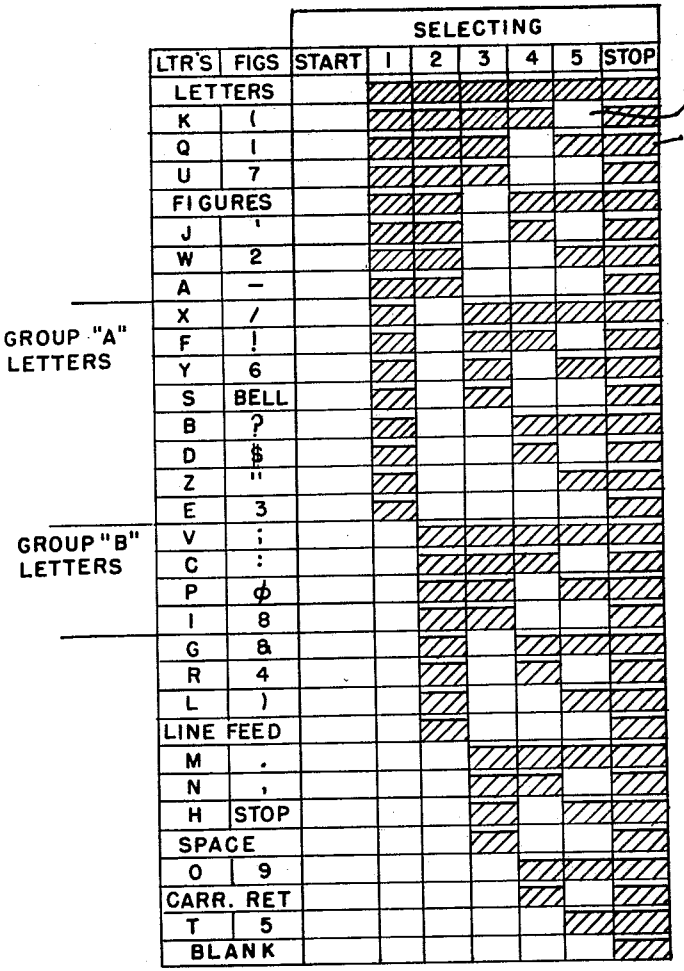
FIG. 1 is a teletype code chart.

From the code chart of FIG. 1 it can be seen that none of the machine functions possess a mark-space sequence in intervals 1 and 2 or a space-mark-mark sequence in intervals 1–3. The letters having these mark-space sequences are labelled Group A and Group B respectively in FIG. 1. When these identifying signal sequences are received at the countermeasures site, it is permissible to effect countermeasures for the remaining intervals. Any change made in the remaining intervals will always result in another letter and not a machine function. If it is permissible to change a letter to a machine function, a change can be made in any interval other than the stop-start intervals of the received character.

There are three possible changes that can be made in the mark-space sequence of a teletype character. These changes are:

1. Change the marks to spaces, do not change the spaces - unidirectional conversion.
2. Change the spaces to marks, do not change the marks - unidirectional change.
3. Change the marks to spaces and change the spaces to marks - bidirectional change.

Figure 2:
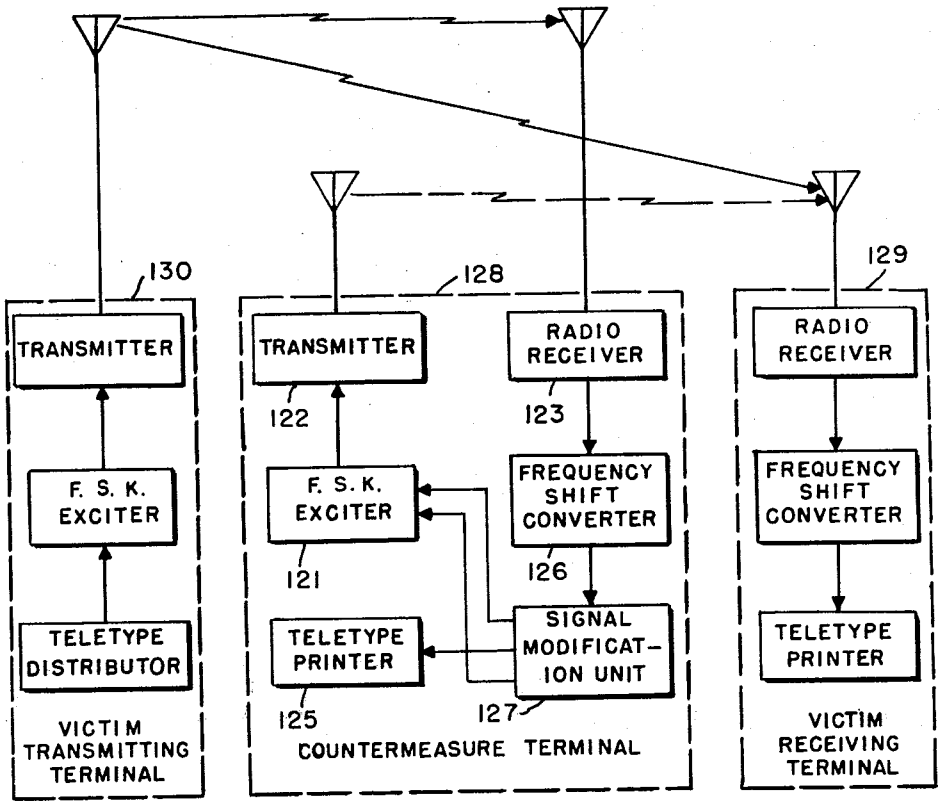
FIG. 2 is a block diagram of the complete countermeasures system.

FIG. 2 is a block diagram of our countermeasures system. A frequency shift keyed teletype signal from the victim's transmitting terminal 130 is received by receiver 123 at countermeasures terminal 128. The output of receiver 123 is applied to converter 126. The converter changes the frequency-shift signals to mark-space current pulses. The current pulses are applied to modification unit 127. The modification unit itself is the subject matter of copending application Ser. No. 171,319 filed Feb. 5, 1962 and assigned to the assignee of this invention; however, a brief description of the modification unit may facilitate a clearer understanding of this invention.

The modification unit comprises three channels. One channel is used to convert Group A letters, the second channel is used to convert Group B letters, and the third channel is used to convert all the teletype characters. A multiple position switch allows the operator to use either of the three channels independently, or the two channels for converting Groups A and B letters can be used together. Another group of switches allows a unidirectional or bidirectional change to be made in any or all of the five intervals. Of course, only intervals 3, 4, and 5 can be changed in the Group A letters and only intervals 4 and 5 of the Group B letters, if a machine function is to be avoided. Modification unit 127 essentially compares the incoming marks and spaces with the program established by the above mentioned switches. If those marks and spaces do not correspond to the programmed marks and spaces, modification unit 127 keys exciter 121 which in turn keys transmitter 122. Transmitter 122 then sends out an appropriate pulse to change the mark or space pulse received at the victim's receiving terminal 129. Modificaion unit 127 also disables receiver 123 and provides a copy of the victim's message by means of teletype printer 125.

The operation of our countermeasures system may be more clearly understood if a specific example of the operation is described. Assume that modification unit 127 is programmed to make a unidirectional change of mark to space for Group A letters only. Also assume that the victim's transmitter is sending the word "sat". Receiver 123 picks up the victim's frequency shift keyed signals and they are converted by converter 126. The output of converter 126 is applied to modification unit 127. The modification unit senses the first two intervals of the letter "s" and recognizes that this is a Group A letter. Since this letter has a mark in the third interval this mark will be changed to a space. This change is accomplished by keying exciter 121 in such a manner as to obtain a space frequency pulse from transmitter 122.

The victim's receiver has now received the mark-space sequence of mark-space-space-space-space which is the mark-space sequence of the letter "E". Thus the letter "S" has been changed to the letter "E". The remaining two letters of the word "sat" are "a" and "t". The letters "a" and "t" are not Group A letters, thus no change is made by the system. The end result is that the victim's teletype printer prints the word "eat" rather than the word "sat" that was originally transmitted.

Transmitter 122 is on the air only when a change is made by the countermeasures system. Thus, in the above example the transmitter was on the air only long enough to transmit the space pulse. During the time that transmitter 122 is on the air receiver 123 is disabled; however, printer 122 prints the original pulse transmitted by the victim.

From the foregoing remarks it should be obvious that our invention has some very desirable features that are not present in any conventional countermeasures system. Some of these desirable features are low power consumption because transmitter 122 is turned on only intermittently; a copy of the victim's message is received even during countermeasures by means of printer 125, and the victim can not readily detect the countermeasures operation because transmitter 122 is only intermittently keyed.

Various changes and modifications in our invention will be apparent to those skilled in the art, and to the extent that such changes and modifications are embraced by the appended claims, it is to be understood that they constitute a part of our invention.

We claim:

1. A method for jamming frequency-shift-keyed radio teletype signals which comprises: receiving said frequency-shift keyed signals; converting said signals to teletype current pulses; modification of selected ones of said teletype pulses; converting said modified teletype current pulses to frequency shifted signals; and transmitting said converted modified pulses.

2. A method for jamming frequency-shift keyed radio teletype signals which comprises: receiving said frequency-shift keyed signals; converting said signals to teletype current pulses; sensing the mark-space sequence of said teletype pulses; changing the mark-space sequence of selected teletype characters; and transmitting only those marks or spaces that have been changed.

3. A method for jamming frequency-shift keyed radio teletype signals which comprises: receiving said frequency-shift keyed signals; sensing the mark-space sequence of said signals; changing the mark-space sequence of certain preselected teletype characters by changing a selected number of the marks of said teletype characters to spaces; and transmitting only said changed marks.

4. A method for jamming frequency-shift keyed radio teletype signals which comprises receiving said frequency-shift keyed signals; sensing the mark-space sequency of said signals; changing the mark-space sequency of certain preselected teletype characters by changing a selected number of the spaces of said preselected teletype character to marks; and transmitting only said changed spaces.

5. A method for jamming frequency-shift keyed radio teletype signals which comprises receiving said frequency-shift keyed signals; sensing the mark-space sequence of said signals; changing the mark-space sequence of preselected teletype characters by changing a selected number of the marks of said teletype characters to spaces and a selected number of the spaces of said teletype character to marks; and transmitting only the changed marks and spaces.

6. A countermeasures system for jamming frequency-shift keyed radio teletype signals comprising: a radio receiver for receiving said signals; a frequency-shift converter coupled to the output of said receiver; a signal modification unit coupled to the output of said converter; a frequency-shift keyer coupled to the output of said modification unit; a transmitter coupled to the output of said keyer; and a teletype printer coupled to said modification unit.

7. A countermeasures system for jamming frequency-shift keyed radio teletype signals comprising: a radio receiver for receiving said signals; a frequency-shift converter having an input coupled to the output of said receiver and having an output; a signal modification unit having an input coupled to said converter output and first, second and third outputs; a teletype printer coupled to the first of said modifier outputs; a frequency-shift keyer having an output and having first and second inputs coupled to said second and third modification unit outputs respectively, and a radio transmitter coupled to said keyer output.

* * * * *